US007026762B2

(12) United States Patent
Shon et al.

(10) Patent No.: US 7,026,762 B2
(45) Date of Patent: Apr. 11, 2006

(54) MAGNETRON, AND MICROWAVE OVEN AND HIGH-FREQUENCY HEATING APPARATUS EACH EQUIPPED WITH THE SAME

(75) Inventors: Jong-Chull Shon, Suwon (KR); Boria V. Rayskiy, Suwon (KR); Hyun-Jun Ha, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 42 days.

(21) Appl. No.: 10/633,573

(22) Filed: Aug. 5, 2003

(65) Prior Publication Data

US 2004/0108816 A1 Jun. 10, 2004

(30) Foreign Application Priority Data

Dec. 10, 2002 (KR) ..... 10-2002-0078049

(51) Int. Cl.
*H01J 25/50* (2006.01)

(52) U.S. Cl. ..... 315/39.51; 219/678

(58) Field of Classification Search ..... 315/39.51, 315/39.63, 39.67, 39.71, 39.75; 219/761, 219/757, 751, 678
See application file for complete search history.

(56) References Cited

U.S. PATENT DOCUMENTS 4,204,138 A * 5/1980 Koinuma et al. ..... 315/39.51
4,310,786 A * 1/1982 Kumpfer et al. ..... 315/39.51
4,426,601 A * 1/1984 Tsuzurahara ..... 315/39.51
4,445,873 A * 5/1984 Tsuzurabara ..... 445/6
5,541,391 A * 7/1996 Seong ..... 219/761
6,653,788 B1 * 11/2003 Ogura et al. ..... 315/39.51

FOREIGN PATENT DOCUMENTS

JP 2002-163992 6/2002

OTHER PUBLICATIONS

Park, Seung-Ho, Korean Patent Abstract Publication No. 1019930000576, Publication Date 19930125, Application No. 1019900014950, Application Date 19900920, Abstract only.

* cited by examiner

*Primary Examiner*—Wilson Lee
(74) *Attorney, Agent, or Firm*—Staas & Halsey LLP

(57) ABSTRACT

A magnetron includes a ring-shaped anode, a cathode, an activating space, at least one permanent magnet and a magnetic flux carrying unit. The ring-shaped anode forms a plurality of resonance circuits. The cathode is disposed at the axial center of the anode to emit thermions. The activating space is formed between the anode and the cathode. The at least one permanent magnet is provided beside the anode. The magnetic flux carrying unit carries magnetic flux generated by the at least one permanent magnet to the activating space. A microwave oven and/or high frequency heating apparatus may utilize the magnetron.

28 Claims, 8 Drawing Sheets

MAGNETRON, AND MICROWAVE OVEN AND HIGH-FREQUENCY HEATING APPARATUS EACH EQUIPPED WITH THE SAME

CROSS-REFERENCE TO RELATED APPLICATIONS

This application claims the benefit of Korean Application No. 2002-78049, filed Dec. 10, 2002, in the Korean Intellectual Property Office, the disclosure of which is incorporated herein by reference.

BACKGROUND OF THE INVENTION

1. Field of the Invention

The present invention relates generally to a magnetron, and a microwave oven and a high-frequency heating apparatus, each equipped with the magnetron and more particularly, to a magnetron in which the arrangement of magnets applying magnetic flux to the activating space of the magnetron are improved, and the shapes of upper and lower yokes are changed to correspond to the improvement of the arrangement, and a microwave oven and a high-frequency heating apparatus each equipped with the same.

2. Description of the Related Art

A construction of a conventional magnetron is described with reference to an accompanying drawing. As illustrated in FIG. 1, in the conventional magnetron, a plurality of vanes 102 that constitute an anode together with an anode cylinder 101 are radially arranged at regular intervals to form resonance circuits, an antenna 103 is connected to one of the vanes 102 to transmit harmonics to the outside, and the vanes 102 are alternately connected to each other by two pairs of strip rings 108. Additionally, a cathode including a filament 106 that is fabricated in the form of a coil spring to emit thermions is disposed along the central axis of the anode cylinder 101. An activating space 107 is formed between the filament 106 and the radially inner ends of the vanes 102. Meanwhile, an upper shield 109*a* and a lower shield 109*b* are attached to the top and bottom of the filament 106, respectively. A center lead 110 is fixedly welded to the upper shield 109*a* with its middle portion passed through the through hole of the lower shield 109*b* and the filament 106. A side lead 111 is welded to the bottom of the lower shield 109*b*. The center lead 110 and the side lead 111 are electrically connected to terminals of an external power source (not shown) and consequently form a closed electric circuit, so an electric field is generated in the activating space 107. Meanwhile, an upper permanent magnet 112 and a lower permanent magnet 113 are provided above and below the anode, respectively, with the opposite magnetic poles of the upper and lower permanent magnets 112 and 113 facing each other. An upper pole piece 117 and a lower pole piece 118 are provided to carry magnetic flux generated by the permanent magnets 112 and 113 to the activating space 107. The above-described elements are enclosed by an upper yoke 114 and a lower yoke 115. A closed magnetic circuit has component elements that are arranged in the order of the upper permanent magnet 112, the upper pole piece 117, the activating space 107, the lower pole piece 118, the lower permanent magnet 113, the lower yoke 115, the upper yoke 114 and the upper permanent magnet 112. Cooling fins 116 are provided to discharge heat generated in the anode through the lower yoke 115 to the outside by connecting the high temperature anode cylinder 101 with the lower yoke 115, because the anode cylinder 101 is heated by collisions between the thermions and the anode, that is, the radially inner ends of the vanes 102. Reference numerals 104 and 105 designate an upper shield cup and a lower shield cup, respectively, to keep the activating space vacuumized. FIG. 2 is a perspective view of FIG. 1.

With the above-described construction of the magnetron, when external power is applied to the filament 106, the filament 106 is heated by operating current applied to the filament 106, and thermions are emitted from the filament 106. A group of thermions formed by continuously emitted thermions alternately impart a potential difference to each neighboring pair of vanes 102 while coming in contact with the radially inner ends of the vanes 102 after undergoing combined rectilinear and rotational movement under the influence of electric and magnetic fields generated in the activating space. Accordingly, oscillations are continuously generated in the resonance circuits of the anode, and harmonics corresponding to the rotation speed of the group of thermions are generated and transmitted to the outside through the antenna 103.

In general, the magnetrons are widely used as component parts in home appliances, such as microwave ovens, as well as in industrial applications, such as high-frequency heating apparatuses, particle accelerators and radar units.

In the meantime, in the conventional magnetron, the permanent magnets are provided above and below the anode in consideration of the uniformity and symmetry of magnetic flux across the activating space of the magnetron, so the height and volume of the magnetron and the lengths of parts (such as the center lead, the side lead, the antenna, the upper and lower shield cups and ceramic (not shown)) made of expensive materials are increased, thus increasing the weight and manufacturing cost of the magnetron.

Meanwhile, in the conventional magnetron, the permanent magnets come in tight contact with the anode heated by the absorption of thermions to suppress an increase in the volume of the magnetron. Hence, the demagnetization of the permanent magnets is caused by the heating of the permanent magnets, and the size of the magnetron is increased in consideration of the decrease of the oscillation efficiency, thus reducing the oscillation efficiency of the magnetron and increasing the weight and manufacturing cost of the magnetron, respectively. Therefore, there have been many attempts to suppress the demagnetization of permanent magnets.

SUMMARY OF THE INVENTION

Accordingly, it is an aspect of the present invention to provide a magnetron that is capable of being miniaturized and manufactured at a low cost due to the miniaturization.

Another aspect of the present invention is to provide a magnetron that is capable of reducing the demagnetization of permanent magnets by suppressing the heating of the permanent magnets, thus increasing the oscillation efficiency of the magnetron.

Additional aspects and advantages of the invention will be set forth in part in the description which follows and, in part, will be obvious from the description, or may be learned by practice of the invention.

The foregoing and/or other aspects of the present invention may be achieved by providing a magnetron, including a ring-shaped anode forming a plurality of resonance circuits, a cathode disposed at an axial center of the anode to emit thermions, an activating space formed between the anode and the cathode, one or more permanent magnets provided beside the anode, and a unit to carry magnetic flux generated by the permanent magnets to the activating space.

The permanent magnets may be spaced apart from the anode by a certain interval.

The magnetic flux carrying means may include an upper magnetic flux carrying unit carrying the magnetic flux to an upper portion of the activating space and a lower magnetic flux carrying unit carrying the magnetic flux to a lower portion of the activating space.

The permanent magnets, the upper magnetic flux carrying unit, the activating space, and the lower magnetic flux carrying unit may form a closed magnetic circuit in a normal or reverse order thereof.

The upper magnetic flux carrying unit may include an upper pole piece carrying the magnetic flux to the upper portion of the activating space and an upper yoke magnetically connecting the permanent magnets with the upper pole piece. The lower magnetic flux carrying unit may include a lower pole piece carrying the magnetic flux to the lower portion of the activating space and a lower yoke magnetically connecting the permanent magnets with the lower pole piece.

The permanent magnets, the upper yoke, the upper pole piece, the activating space, the lower pole piece and the lower yoke may form a closed magnetic circuit in a normal or reverse order thereof.

The foregoing and/or other aspects of the present invention may be achieved by providing a magnetron, including a ring-shaped anode forming a plurality of resonance circuits, a cathode disposed at an axial center of the anode to emit thermions, an activating space formed between the anode and the cathode, one or more permanent magnets generating magnetic flux to be applied to the activating space, upper and lower pole pieces carrying the magnetic flux to upper and lower portions of the activating space, respectively, and upper and lower yokes magnetically connecting the permanent magnets with the upper and lower pole pieces, respectively. The permanent magnets, the upper yoke, the upper pole piece, the activating space, the lower pole piece, and the lower yoke form a closed magnetic circuit in a normal or reverse order thereof.

The permanent magnets may be spaced apart from the anode by a certain interval.

The foregoing and/or other aspects of the present invention may be achieved by providing a magnetron, including a ring-shaped anode forming a plurality of resonance circuits, a cathode disposed at an axial center of the anode to emit thermions, an activating space formed between the anode and the cathode, one or more permanent magnets provided beside the anode to be spaced apart therefrom by a certain interval to generate magnetic flux to be applied to the activating space, and a unit to carry magnetic flux generated by the permanent magnets to the activating space.

The magnetic flux carrying unit may include an upper magnetic flux carrying unit carrying the magnetic flux to an upper portion of the activating space and a lower magnetic flux carrying unit carrying the magnetic flux to a lower portion of the activating space.

The upper magnetic flux carrying unit may include an upper pole piece carrying the magnetic flux to the upper portion of the activating space and an upper yoke magnetically connecting the permanent magnets with the upper pole piece, and the lower magnetic flux carrying unit may include a lower pole piece carrying the magnetic flux to the lower portion of the activating space and a lower yoke magnetically connecting the permanent magnets with the lower pole piece.

The foregoing and/or other aspects of the present invention may be achieved by providing a magnetron, including a ring-shaped anode forming a plurality of resonance circuits, a cathode disposed at an axial center of the anode to emit thermions, an activating space formed between the anode and the cathode, one or more permanent magnets provided beside the anode, upper and lower pole pieces carrying the magnetic flux generated by the permanent magnets to upper and lower portions of the activating space, respectively, upper and lower yokes magnetically connecting the permanent magnets with the upper and lower pole pieces, respectively, and covering tops and bottoms of the permanent magnets, respectively, and units to attach the permanent magnets to the upper and lower yokes.

The attaching units may include attaching holes formed in the upper and lower yokes, respectively, through holes formed in the permanent magnets, respectively, and rivets or bolts and nuts adapted to attach the permanent magnets to the upper and lower yokes while passing through the attaching and through holes.

The rivets or bolts may be made of non-magnetic or paramagnetic material.

The paramagnetic material may be aluminum or copper.

The upper yoke may be provided at one or more side ends thereof with one or more mounting tabs that protrude outside outer surfaces of one or more of the permanent magnets to be used to attach the magnetron to an object.

The permanent magnets may have outside surfaces that exist outside or coincide with radially outer ends of the upper and lower yokes.

The permanent magnets may have a polarization direction parallel with the axial center direction.

The permanent magnets may include a plurality of magnets, and have a same polarization direction.

The foregoing and/or other aspects of the present invention may be achieved by providing a magnetron, including a ring-shaped anode forming a plurality of resonance circuits, a cathode disposed at an axial center of the anode to emit thermions, an activating space formed between the anode and the cathode, one or more permanent magnets provided beside the anode to be longer than the anode in an axial center direction of the magnetron, and units to carry magnetic flux generated by the permanent magnets to the activating space.

The magnetic flux carrying units may include an upper magnetic flux carrying unit carrying the magnetic flux to an upper portion of the activating space and a lower magnetic flux carrying unit carrying the magnetic flux to a lower portion of the activating space.

The upper magnetic flux carrying unit may include an upper pole piece carrying the magnetic flux to the upper portion of the activating space and an upper yoke magnetically connecting the permanent magnets with the upper pole piece, and the lower magnetic flux carrying unit may include a lower pole piece carrying the magnetic flux to the lower portion of the activating space and a lower yoke magnetically connecting the permanent magnets with the lower pole piece.

The foregoing and/or other aspects of the present invention may be achieved by providing a microwave oven which includes the above-mentioned magnetron.

The foregoing and/or other aspects of the present invention may be achieved by providing a high-frequency heating apparatus which includes the above-mentioned magnetron.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
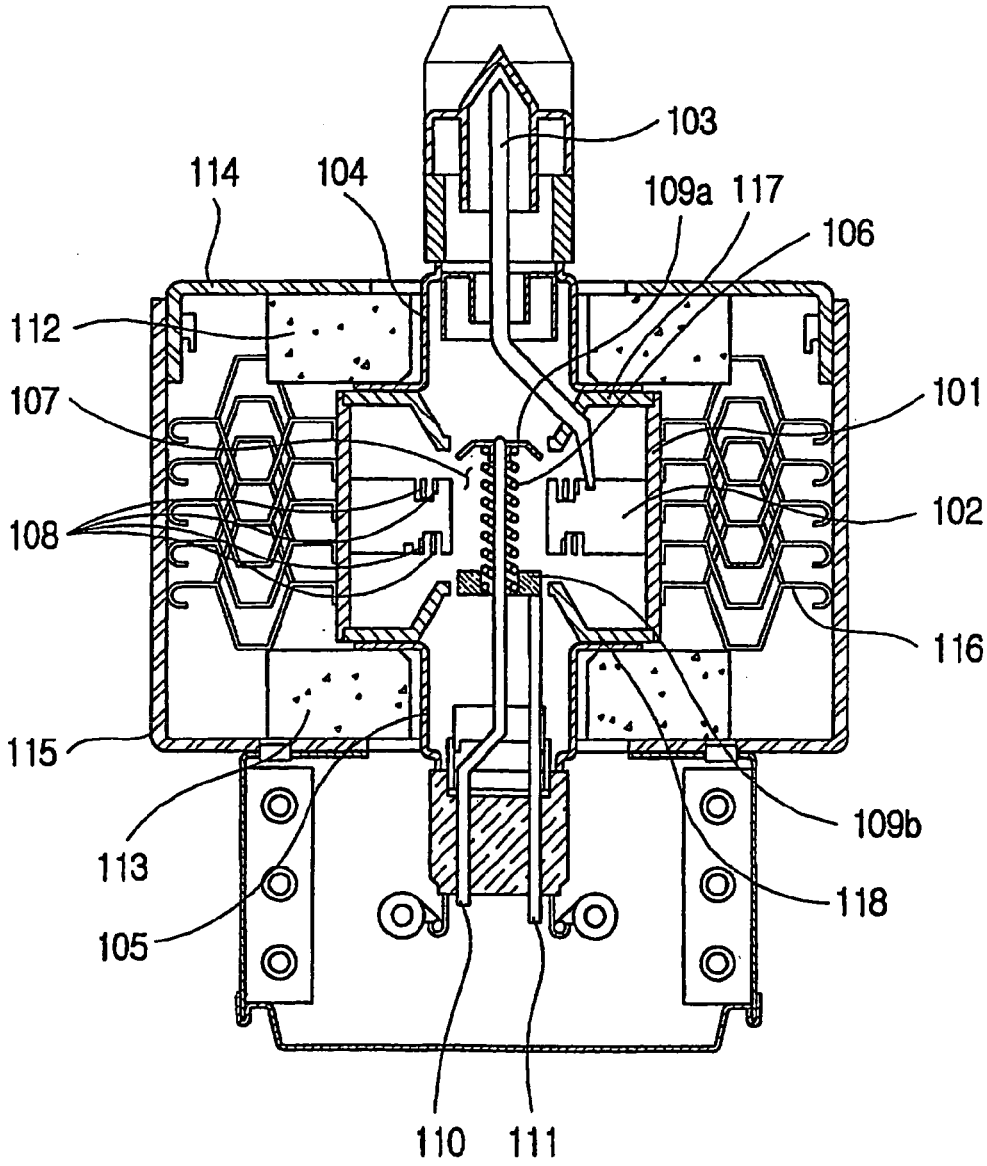
FIG. 1 PRIOR ART
FIG. 1 is a longitudinal cross section of a conventional magnetron.
Figure 2:
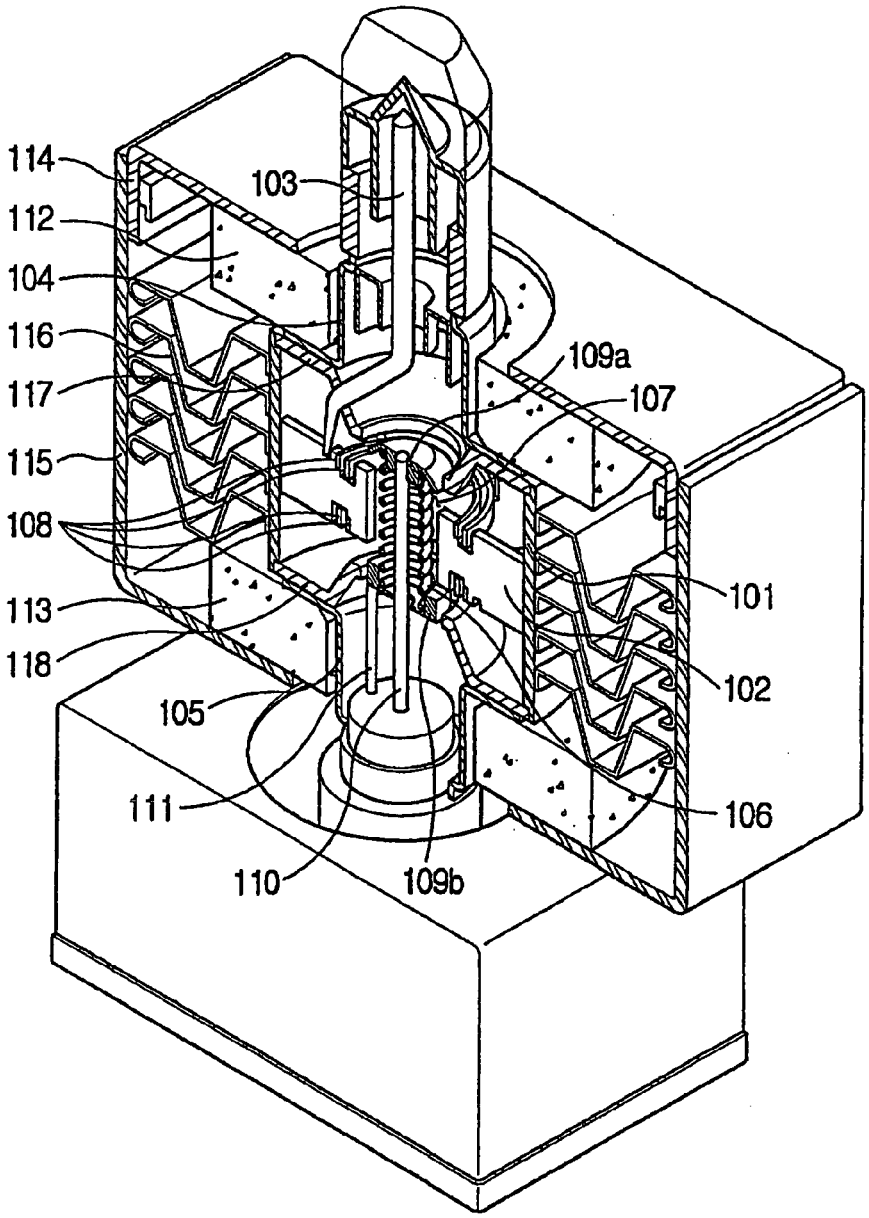
FIG. 2 PRIOR ART
FIG. 2 is a cutaway perspective view of the magnetron of FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures. Additionally, for clarity of description, the rotational direction of magnetic flux due to the polarization of north and south poles of a magnet is ignored.

Figure 3:
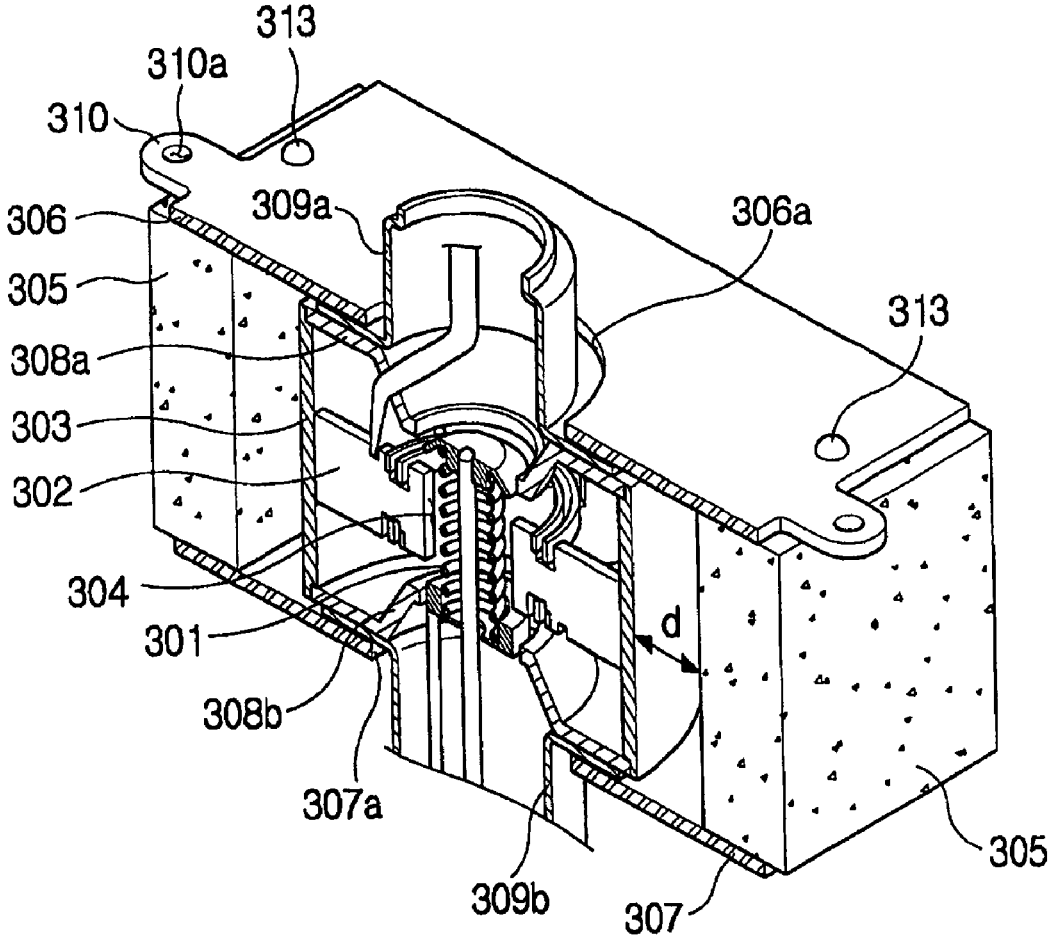
FIG. 3 is a longitudinal section showing a principal portion of a magnetron, according to an embodiment of the present invention.

FIG. 3 is a longitudinal section showing a principal portion of a magnetron according to an embodiment of the present invention. In FIG. 3, a ring-shaped anode including a plurality of vanes forming a plurality of resonance circuits and an anode cylinder 303 is provided, a cathode including a filament 301 emitting thermions at high temperature is disposed at the axial center of the anode, and an activating/predetermined space 304 in which groups of thermions move under the influence of electric and magnetic fields is formed between the anode and the cathode. Meanwhile, two hexahedral permanent magnets 305 are arranged to the right and left sides of the anode, respectively, each being spaced apart from the anode by an interval "d". Open spaces or cooling fins in open spaces are preferably disposed in front and back of the anode, so the anode may be surrounded and cooled by external air.

In the meantime, to apply magnetic flux to the activating space 304, an upper pole piece 308*a*, a lower pole piece 308*b*, an upper yoke 306 and a lower yoke 307 are provided. The upper pole piece 308*a* is positioned above the anode to carry magnetic flux to the upper portion of the activating space 304, and magnetically connected with the top surfaces of the two permanent magnets 305 by the upper yoke 306. Likewise, the lower pole piece 308*b* is positioned below the anode to carry magnetic flux to the lower portion of the activating space 304, and magnetically connected with the bottom surfaces of the two permanent magnets 305 by the lower yoke 307. The upper and lower yokes 306 and 307 are fabricated in the form of rectangular plates with center holes 306*a* and 307*a*. In this case, the upper pole piece 308*a* and the upper yoke 306 may be called an upper magnetic flux carrying unit that functions to carry magnetic flux to the upper portion of the activating space 304, and the lower pole piece 308*b* and the lower yoke 307 may be called a lower magnetic flux carrying unit that functions to carry magnetic flux to the lower portion of the activating space 304. Of course, the upper and lower magnetic flux carrying units may be called a magnetic flux carrying means.

Although the polarization directions of south and north poles of the two permanent magnets 305 are preferably parallel with the axial center direction of the anode to allow the upper and lower yokes 306 and 307 to be constructed in the form of square plates to cover the tops and bottoms of the permanent magnets 305, any polarization direction of the permanent magnets and any shape of the yokes satisfying the order of the closed magnetic circuit may be employed.

Meanwhile, an upper shield cup 309*a* and a lower shield cup 309*b* are extended to a space between the upper yoke 306 and the upper pole piece 308*a* and a space between the lower yoke 307 and the lower pole piece 308*b*, respectively. Even though the upper shield cup 309*a* and the lower shield cup 309*b* are situated between the upper yoke 306 and the upper pole piece 308*a* and between the lower yoke 307 and the lower pole piece 308*b*, respectively, and may be included in a magnetic circuit in terms of the positions thereof, the upper and lower shield cups 309*a* and 309*b* are generally excluded from a magnetic circuit of a magnetron due to not having any function in constituting the magnetic circuit and not greatly affecting the magnetic circuit due to the small construction thereof.

Two mounting tabs 310 are extended from the side ends of the upper yoke 306 outside the permanent magnets 305, respectively, and two mounting holes 310*a* are formed in the two mounting tabs 310, respectively. Accordingly, the magnetron may be attached to an object, such as a microwave oven, through the use of the mounting tabs 310.

In the meantime, the outer side ends of the permanent magnets 305 are located outside the side ends of the upper and lower yokes 306 and 307. Accordingly, a magnetic flux leakage, which may occur when the side ends of the upper and lower yokes 306 and 307 are located outside the outer side ends of the permanent magnets 305, may be prevented, and an additional magnetic circuit is formed between the side ends of the upper yoke 306 and the side ends of the lower yoke 307. Of course, even when the side ends of the upper and lower yokes 306 and 307 coincide with the outer ends of the permanent magnets 305, a considerable amount of magnetic flux leakage may be reduced, so the above construction is also desirable.

Figure 4:
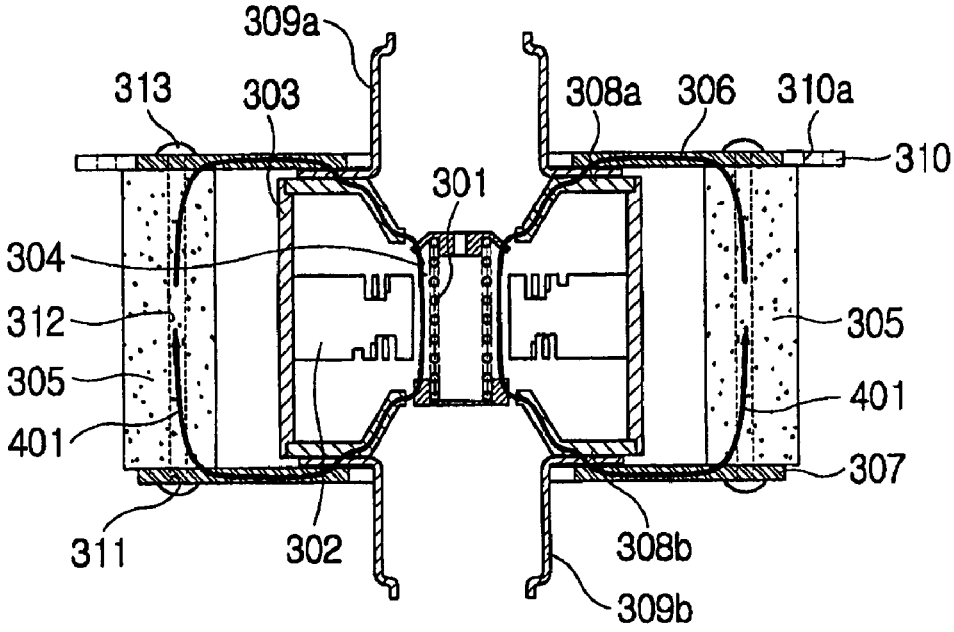
FIG. 4 is a front view of FIG. 3.

Reference numeral 313 of FIG. 3 is described with reference to FIG. 4. FIG. 4 is a front view of FIG. 3. In this drawing, the two permanent magnets 305 are attached to the upper and lower yokes 306 and 307 by an attaching unit. That is, the upper and lower yokes 306 and 307 are provided with attaching holes 311, the permanent magnets 305 are provided with through holes 312, and the permanent magnets 305 are attached to the upper and lower yokes 306 and 307 by rivets 313 passing through the attaching holes 311 and the through holes 312. Bolts and nuts may be employed instead of the rivets. Since the rivet 313 or bolts connect the poles of the permanent magnets to each other, the rivets 313 or bolts may be made of a non-magnetic material or paramagnetic material, inclusive of aluminum and copper, to maximally suppress magnetic flux leakage.

In the magnetron constructed as described above, the permanent magnets, the upper yoke, the upper pole piece, the activating space, the lower pole piece and the lower yoke form a closed magnetic circuit in the normal or reverse order thereof according to the arrangement of polarization of the permanent magnets.

Magnetic paths 401 formed by the closed magnetic circuit are indicated by solid arrows in FIG. 4.

An operation of the magnetron constructed as described above is described below. When operating current is applied to the magnetron, the filament 301 is heated and an electric field is generated in the space between the anode and the cathode, that is, the activating space 304, due to a certain potential difference. Accordingly, thermions are emitted from the heated filament 301, and move to the radially inner ends of the vanes 302 at a certain velocity under the influence of the electric field generated in the activating space 304. Meanwhile, since magnetic flux generated by the permanent magnets 305 situated beside the anode follows the above-described closed magnetic circuit, the magnetic flux is applied to the upper portion of the activating space 304 with the aid of the upper yoke 306 and the upper pole piece 308*a*, and to the lower portion of the activating space 304 with the aid of the lower yoke 307 and the lower pole piece 308*b*. The thermions are subjected to magnetic force corresponding to the speed of the thermions under the influence of the magnetic field generated by the application of the magnetic flux, which force is a Lorentz force. The rectilinear movement of the thermions is controlled by the electric field, while the rotational movement of the thermions is controlled by the magnetic field. A group of thermions produced by thermions continuously emitted from the filament 301 alternately apply an electrical potential difference to each pair of neighboring vanes while undergoing combined rectilinear and rotational movement and coming into collision with the radially inner ends of the vanes 302. Harmonics corresponding to the rotational speed of the group of thermions are generated, and transmitted to the outside through the antenna 303. Meanwhile, high temperature heat is transmitted to the anode while the thermions come into collision with the vanes 302, and the heated anode is cooled by external air passing through a space defined by open spaces in front and back of the anode and intervals "d" between the two permanent magnets 305 and the anode. Consequently, the permanent magnets 305 are prevented from receiving heat from the anode and being heated.

Figure 5:
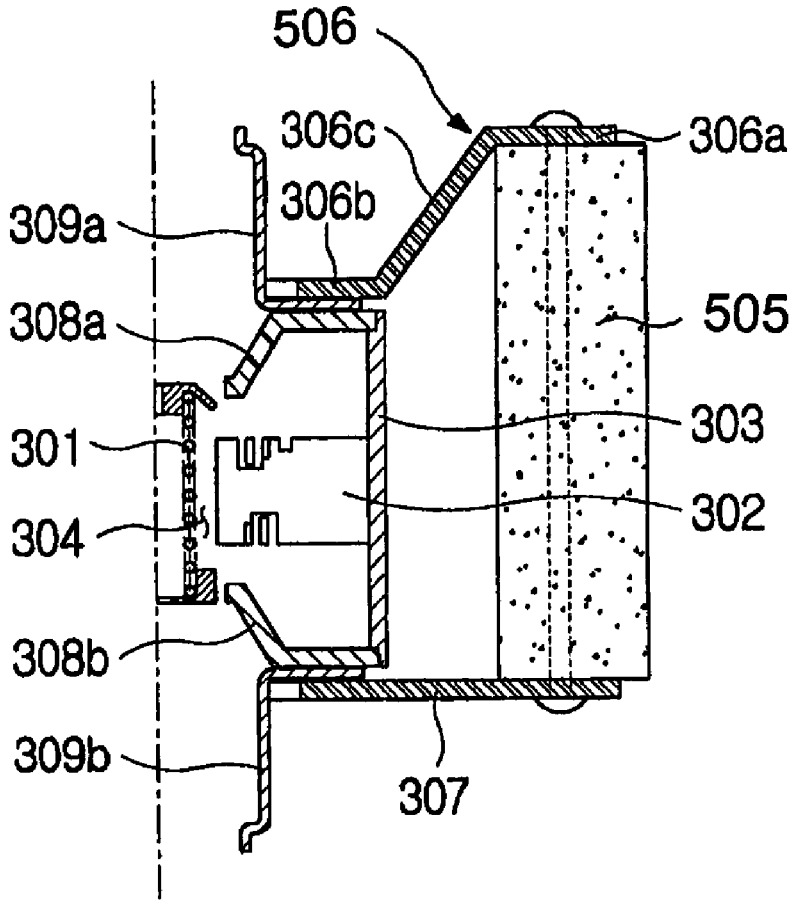
FIGS. 5 to 7 are views showing other magnetrons, according to other embodiments of the present invention.
Figure 6:
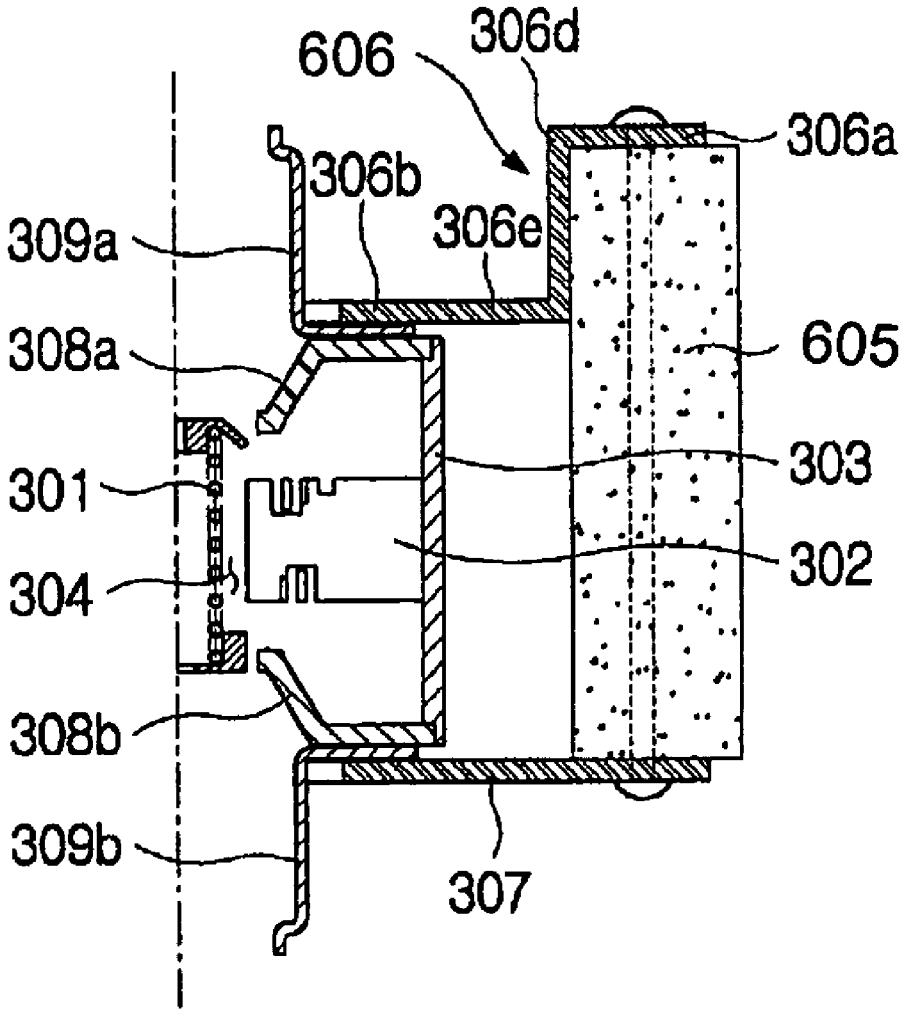
Figure 7:
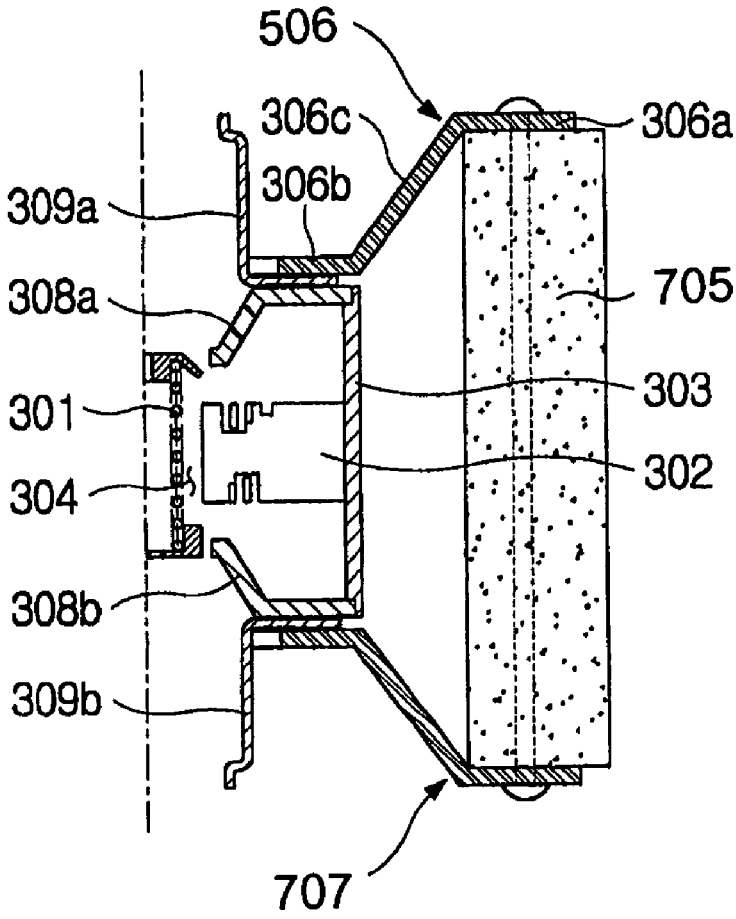

FIGS. 5 to 7 show magnetrons according to other embodiments of the present invention. Generally, in a large capacity magnetron, a magnetic field strength in the activating space 304 should be sufficiently large to correspond to the large capacity of the magnetron, and accordingly, the amount of magnetic flux should be large, so the size of a magnet should be large based on the desired amount of magnetic flux. In this case, a large magnet may be constructed by increasing the length of a magnet in the direction of the axial center thereof so that the magnet is longer than the anode, as illustrated in FIGS. 5 to 7. FIG. 5 shows a magnetron according to an embodiment of the present invention, in which magnetic field strength in the activating space 304 is increased by allowing permanent magnets 505 to protrude above an anode and changing the shape of an upper yoke 306 accordingly. The upper yoke 506 includes a magnet bordering portion 306*a* bordering the tops of the permanent magnets 505, a pole piece bordering portion 306*b* bordering the tops of pole pieces 308*a*, and a connecting portion 306*c* slantingly connecting the magnet bordering portion 306*a* and the pole piece bordering portion 306*b*. In FIG. 6, an upper yoke 606 has a stepped shape, and includes a magnet bordering portion 306*d* bordering the tops and inside surfaces of the permanent magnets 605, a pole piece bordering portion 306*b* bordering the tops of pole pieces 308*a*, and a connecting portion 306*e* connecting the magnet bordering portion 306*d* and the pole piece bordering portion 306*b*. The above construction may be applied to the lower portion of the magnetron. When a large amount of magnetic flux is required in the activating space of a magnetron, the permanent magnets 705 may be constructed to protrude above and below an anode, with the upper and lower yokes 506 and 707 shaped to accommodate the permanent magnets 705, as shown in FIG. 7.

The magnetron according to an embodiment of the present invention may be applied to a variety of apparatuses that require magnetrons, such as widely known high frequency heating apparatuses or microwave ovens.

The magnetron of the present invention described above has permanent magnets which are provided beside an anode and spaced apart from the anode by a predetermined distance, so that a magnetron having the characteristic construction falls under the scope of the present invention.

The magnetron of the present invention has the following effects. First, permanent magnets are arranged beside the anode, so that the length and volume of the magnetron are reduced, thus reducing the lengths of expensive component parts and therefore, the manufacturing cost of the magnetron. Second, the miniaturization of the magnetron is implemented, so space occupied by the magnetron is reduced in an apparatus on which the magnetron is mounted, thus providing sufficient space to utilize. Third, permanent magnets do not come in contact with an anode, so the demagnetization of the permanent magnets is prevented, thus increasing the oscillation efficiency of the magnetron and further miniaturizing the magnetron.

Figure 8:
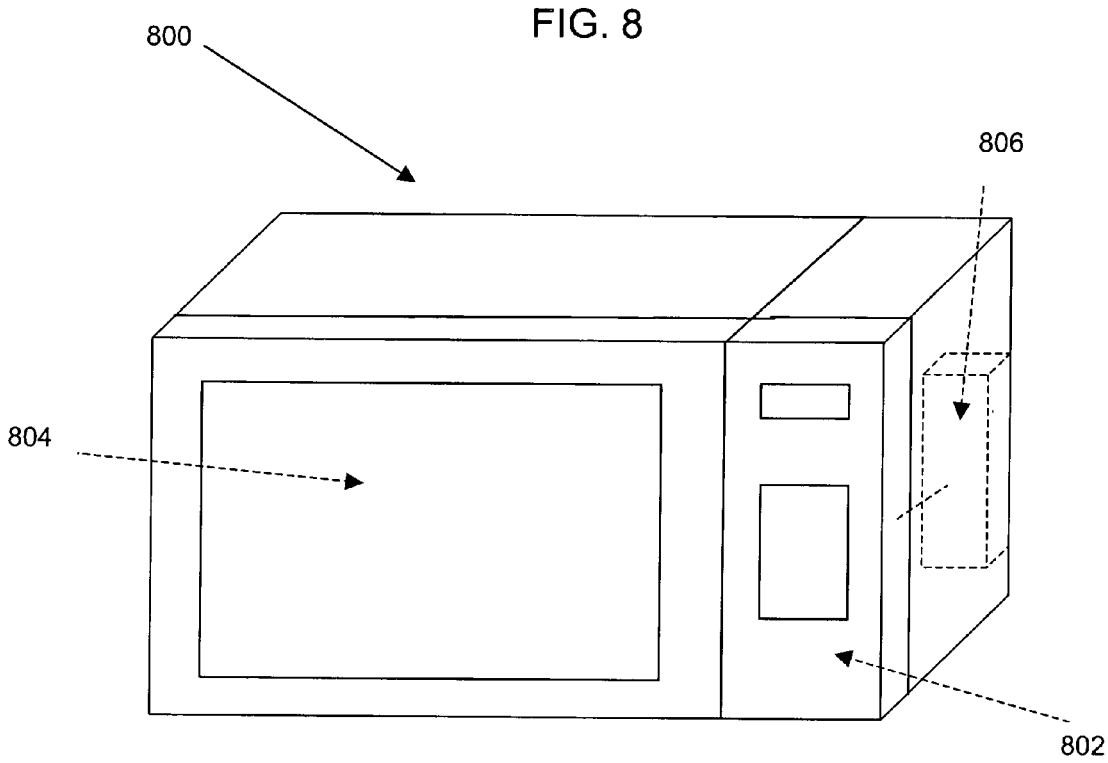
FIG. 8 is a schematic representation of a microwave that implements a magnetron in accordance with an embodiment of the present invention.

The magnetron of the present invention may be used in a microwave oven. As illustrated in FIG. 8, in such an implementation, the microwave oven 800 typically also includes a control unit 802, a cooking cavity 804 and a heating unit 806, wherein the heating unit includes the magnetron. In general, the control unit 802 may be operated by user input, controlling the amount of heat to be delivered by the magnetron in the heating unit 806, so that food may be cooked in the cooking cavity 804. Since numerous control units are known in the art for use in microwave ovens, no further description of a control unit is provided.

Figure 9:
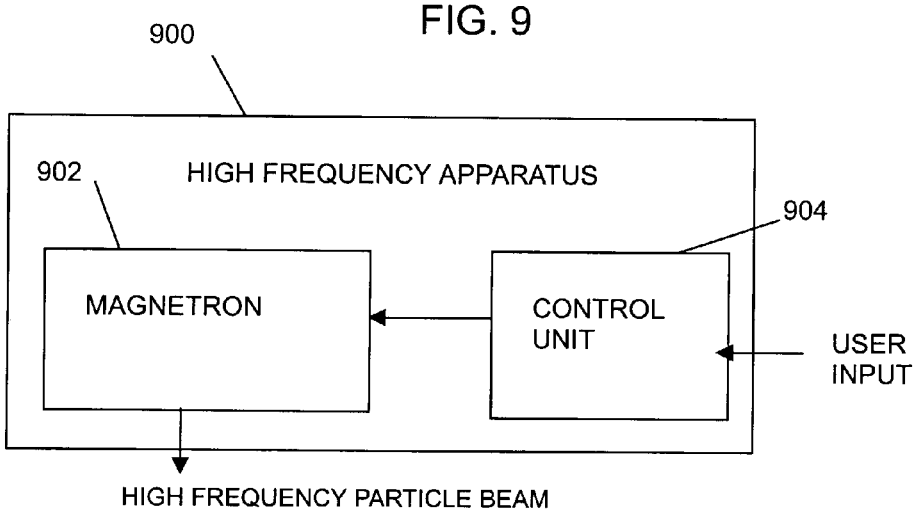
FIG. 9 is a block diagram of a high frequency apparatus having a magnetron in accordance with an embodiment of the present invention.

The magnetron of the present invention may be used in industrial applications such as, for example, high frequency heating apparatuses, particle accelerators and radar units. As shown in the block diagram of FIG. 9, a high frequency apparatus 900 such as a high frequency heating apparatus, a particle accelerator or a radar unit in accordance with the present invention typically includes a magnetron 902 as described herein that generates a high frequency particle beam and a control unit 904 that controls an intensity of the high frequency particle beam. Since numerous control units are known in the art for use in high frequency apparatuses, no further description of a control unit is provided.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A magnetron, comprising:

a ring-shaped anode forming a plurality of resonance circuits wherein the ring-shaped anode is arranged to provide a ring lying in a horizontal plane;

a cathode disposed at an axial center of the anode to emit thermions, separated from the anode by a predetermined space;

at least one permanent magnet arranged co-axially with the anode along a horizontal axis lying in the horizontal plane to reduce demagnetization of the at least one permanent magnet and a height of the magnetron; and a magnetic flux carrying unit to carry magnetic flux generated by the at least one permanent magnet to the predetermined space.

2. The magnetron as set forth in claim 1, wherein the at least one permanent magnet is spaced apart from the anode by a predetermined interval.

3. The magnetron as set forth in claim 1, wherein the magnetic flux carrying unit comprises an upper magnetic flux carrying unit carrying the magnetic flux to an upper portion of the predetermined space and a lower magnetic flux carrying unit carrying the magnetic flux to a lower portion of the predetermined space.

4. The magnetron as set forth in claim 3, wherein the at least one permanent magnet, the upper magnetic flux carrying unit and the lower magnetic flux carrying unit form a closed magnetic circuit in a normal or reverse order thereof.

5. The magnetron as set forth in claim 3, wherein:

the upper magnetic flux carrying unit comprises an upper pole piece carrying the magnetic flux to the upper portion of the predetermined space and an upper yoke magnetically connecting the permanent magnets with the upper pole piece; and the lower magnetic flux carrying unit comprises a lower pole piece carrying the magnetic flux to the lower portion of the predetermined space and a lower yoke magnetically connecting the permanent magnets with the lower pole piece.

6. The magnetron as set forth in claim 5, wherein the at least one permanent magnet, the upper yoke, the upper pole piece, the lower pole piece and the lower yoke form a closed magnetic circuit in a normal or reverse order thereof.

7. A magnetron, comprising:

a ring-shaped anode forming a plurality of resonance circuits wherein the ring-shaped anode is arranged to provide a ring lying in a horizontal plane;

a cathode disposed at an axial center of the anode to emit thermions, separated from the anode by a predetermined space;

at least one permanent magnet arranged co-axially with the anode along a horizontal axis lying in the horizontal plane to reduce demagnetization of the at least one permanent magnet and a height of the magnetron and generating magnetic flux to be applied to the predetermined space;

upper and lower pole pieces carrying the magnetic flux to upper and lower portions of the predetermined space, respectively; and upper and lower yokes magnetically connecting the permanent magnets with the upper and lower pole pieces, respectively;

wherein the at least one permanent magnet, the upper yoke, the upper pole piece, the lower pole piece, and the lower yoke form a closed magnetic circuit in a normal or reverse order thereof.

8. The magnetron as set forth in claim 7, wherein the at least one permanent magnet is spaced apart from the anode by a predetermined interval.

9. A magnetron, comprising:

a ring-shaped anode forming a plurality of resonance circuits wherein the ring-shaped anode is arranged to provide a ring lying in a horizontal plane;

a cathode disposed at an axial center of the anode to emit thermions, separated from the anode by a predetermined space;

at least one permanent magnet arranged co-axially with the anode along a horizontal axis lying in the horizontal plane to reduce demagnetization of the at least one permanent magnet and a height of the magnetron and spaced apart therefrom by a predetermined interval to generate magnetic flux to be applied to the predetermined space; and a magnetic flux carrying unit to carry magnetic flux generated by the at least one permanent magnet to the predetermined space.

10. The magnetron as set forth in claim 9, wherein the magnetic flux carrying unit comprises an upper magnetic flux carrying unit carrying the magnetic flux to an upper portion of the predetermined space and a lower magnetic flux carrying unit carrying the magnetic flux to a lower portion of the predetermined space.

11. The magnetron as set forth in claim 10, wherein:

the upper magnetic flux carrying unit comprises an upper pole piece carrying the magnetic flux to the upper portion of the predetermined space and an upper yoke magnetically connecting the permanent magnets with the upper pole piece; and the lower magnetic flux carrying unit comprises a lower pole piece carrying the magnetic flux to the lower portion of the predetermined space and a lower yoke magnetically connecting the permanent magnets with the lower pole piece.

12. A magnetron, comprising:

a ring-shaped anode forming a plurality of resonance circuits wherein the ring-shaped anode is arranged to provide a ring lying in a horizontal plane;

a cathode disposed at an axial center of the anode to emit thermions, separated from the anode by a predetermined space;

at least one permanent magnet arranged co-axially with the anode along a horizontal axis lying in the horizontal Diane to reduce demagnetization of the at least one permanent magnet and a height of the magnetron;

upper and lower pole pieces carrying the magnetic flux generated by the permanent magnets to upper and lower portions of the predetermined space, respectively;

upper and lower yokes magnetically connecting the at least one permanent magnet with the upper and lower pole pieces, respectively, and covering tops and bottoms of the permanent magnets, respectively; and an attaching unit to attach the permanent magnets to the upper and lower yokes.

13. The magnetron as set forth in claim 12, wherein the attaching unit comprises:

attaching holes formed in the upper and lower yokes, respectively;

through holes formed in the permanent magnets, respectively; and rivets or bolts adapted to attach the permanent magnets to the upper and lower yokes while passing through the attaching and through holes.

14. The magnetron as set forth in claim 13, wherein the rivets or bolt and nuts are made of non-magnetic or paramagnetic material.

15. The magnetron as set forth in claim 14, wherein the paramagnetic material is aluminum or copper.

16. The magnetron as set forth in claim 15, wherein the upper yoke is provided at one or more side ends thereof with at least one mounting tab that protrudes outside outer surfaces of the at least one permanent magnet, to be used to attach the magnetron to an object.

17. The magnetron as set forth in claim 12, wherein the at least one permanent magnet has an outside surface that exists outside or coincides with radially outer ends of the upper and lower yokes.

18. The magnetron as set forth in claim 12, wherein the at least one permanent magnet has a polarization direction parallel with the axial center direction.

19. The magnetron as set forth in claim 12, wherein the at least one permanent magnet comprises a plurality of magnets that have a same polarization direction.

20. A magnetron, comprising:

a ring-shaped anode forming a plurality of resonance circuits wherein the ring-shaped anode is arranged to provide a ring lying in a horizontal plane;

a cathode disposed at an axial center of the anode to emit thermions, separated from the anode by a predetermined space;

at least one permanent magnet arranged co-axially with the anode along a horizontal axis lying in the horizontal plane to reduce demagnetization of the at least one permanent magnet and a height of the magnetron and to be longer than the anode in an axial center direction of the magnetron; and a magnetic flux unit to carry magnetic flux generated by the at least one permanent magnet to the predetermined space.

21. The magnetron as set forth in claim 20, wherein the magnetic flux carrying unit comprises an upper magnetic flux carrying unit carrying the magnetic flux to an upper portion of the predetermined space and a lower magnetic flux carrying unit carrying the magnetic flux to a lower portion of the predetermined space.

22. The magnetron as set forth in claim 21, wherein:

the upper magnetic flux carrying unit comprises an upper pole piece carrying the magnetic flux to the upper portion of the predetermined space and an upper yoke magnetically connecting the at least one permanent magnet with the upper pole piece; and the lower magnetic flux carrying unit comprises a lower pole piece carrying the magnetic flux to the lower portion of the predetermined space and a lower yoke magnetically connecting the at least one permanent magnet with the lower pole piece.

23. A microwave oven, comprising:

a cooking cavity in which food is placed to be cooked;

a heating unit to heat the food, the heating unit comprising:

a magnetron, comprising:

a ring-shaped anode forming a plurality of resonance circuits wherein the ring-shaped anode is arranged to provide a ring lying in a horizontal plane;

a cathode disposed at an axial center of the anode to emit thermions, separated from the anode by a predetermined space;

at least one permanent magnet arranged co-axially with the anode along a horizontal axis lying in the horizontal plane to reduce demagnetization of the at least one permanent magnet and a height of the magnetron; and a magnetic flux carrying unit to carry magnetic flux generated by the at least one permanent magnet to the predetermined space, and a control unit to control an amount of heat produced by the heating unit.

24. The microwave oven of claim 23, wherein the magnetic flux carrying unit comprises an upper magnetic flux carrying unit carrying the magnetic flux to an upper portion of the predetermined space and a lower magnetic flux carrying unit carrying the magnetic flux to a lower portion of the predetermined space.

25. A microwave oven, comprising:

a cooking cavity in which food is placed to be cooked;

a heating unit to heat the food, the heating unit comprising:

a magnetron, comprising:

a ring-shaped anode forming a plurality of resonance circuits wherein the ring-shaped anode is arranged to provide a ring lying in a horizontal plane;

a cathode disposed at an axial center of the anode to emit thermions;

an activating space formed between the anode and the cathode;

at least one permanent magnet arranged co-axially with the anode along a horizontal axis lying in the horizontal plane to reduce demagnetization of the at least one permanent magnet and a height of the magnetron and generating magnetic flux to be applied to the activating space;

upper and lower pole pieces carrying the magnetic flux to upper and lower portions of the activating space, respectively; and upper and lower yokes magnetically connecting the permanent magnets with the upper and lower pole pieces, respectively;

wherein the at least one permanent magnet, the upper yoke, the upper pole piece, the activating space, the lower pole piece, and the lower yoke form a closed magnetic circuit in a normal or reverse order thereof; and a control unit to control an amount of heat produced by the heating unit.

26. A microwave oven, comprising:

a cooking cavity in which food is placed to be cooked;

a heating unit to heat the food, the heating unit comprising:

a magnetron, comprising:

a ring-shaped anode forming a plurality of resonance circuits wherein the ring-shaped anode is arranged to provide a ring lying in a horizontal plane;

a cathode disposed at an axial center of the anode to emit thermions;

an activating space formed between the anode and the cathode;

at least one permanent magnet arranged co-axially with the anode along a horizontal axis lying in the horizontal plane to reduce demagnetization of the at least one permanent magnet and a height of the magnetron and spaced apart therefrom by a predetermined interval to generate magnetic flux to be applied to the activating space; and a magnetic flux carrying unit to carry magnetic flux generated by the at least one permanent magnet to the activating space; and a control unit to control an amount of heat produced by the heating unit.

27. A microwave oven, comprising:

a cooking cavity in which food is placed to be cooked;

a heating unit to heat the food, the heating unit comprising:

a magnetron, comprising:

a ring-shaped anode forming a plurality of resonance circuits wherein the ring-shaped anode is arranged to provide a ring lying in a horizontal plane;

a cathode disposed at an axial center of the anode to emit thermions;

an activating space formed between the anode and the cathode;

at least one permanent magnet arranged co-axially with the anode along a horizontal axis lying in the horizontal plane to reduce demagnetization of the at least one permanent magnet and a height of the magnetron;

upper and lower pole pieces carrying the magnetic flux generated by the permanent magnets to upper and lower portions of the activating space, respectively;

upper and lower yokes magnetically connecting the at least one permanent magnet with the upper and lower pole pieces, respectively, and covering tops and bottoms of the permanent magnets, respectively; and an attaching unit to attach the permanent magnets to the upper and lower yokes; and a control unit to control an amount of heat produced by the heating unit.

28. A microwave oven, comprising:

a cooking cavity in which food is placed to be cooked;

a heating unit to heat the food, the heating unit comprising:

a magnetron, comprising:

a ring-shaped anode forming a plurality of resonance circuits wherein the ring-shaped anode is arranged to provide a ring lying in a horizontal plane;

a cathode disposed at an axial center of the anode to emit thermions;

an activating space formed between the anode and the cathode;

at least one permanent magnet arranged co-axially with the anode along a horizontal axis lying in the horizontal plane to reduce demagnetization of the at least one permanent magnet and a height of the magnetron and to be longer than the anode in an axial center direction of the magnetron; and a magnetic flux unit to carry magnetic flux generated by the at least one permanent magnet to the activating space; and a control unit to control an amount of heat produced by the heating unit.

* * * * *

UNITED STATES PATENT AND TRADEMARK OFFICE

CERTIFICATE OF CORRECTION

PATENT NO. : 7,026,762 B2
APPLICATION NO. : 10/633573
DATED : April 11, 2006
INVENTOR(S) : Jong-Chull Shon et al.

It is certified that error appears in the above-identified patent and that said Letters Patent is hereby corrected as shown below:

Column 10, line 44, change “Diane” to --plane--

Signed and Sealed this

Fifteenth Day of August, 2006

JON W. DUDAS
*Director of the United States Patent and Trademark Office*